US006062138A

United States Patent [19]

Fromson et al.

[11] Patent Number: 6,062,138

[45] Date of Patent: May 16, 2000

[54] OFFSET PRINTING HAVING BLANKET CYLINDER WITH BLANKET HAVING DIFFERENT THICKNESSES

[75] Inventors: Howard A. Fromson, 43 Main St., Stonington, Conn. 06378; William J. Rozell, Vernon, Conn.

[73] Assignee: Howard A. Fromson, Stonington, Conn.

[21] Appl. No.: 09/281,638

[22] Filed: Mar. 30, 1999

[51] Int. Cl.[7] ..... B41F 7/02

[52] U.S. Cl. ..... 101/217; 101/376; 428/909

[58] Field of Search ..... 101/217, 375, 101/376, 401.1; 428/909; 492/18, 30, 33, 36, 38, 39, 48

[56] References Cited

U.S. PATENT DOCUMENTS

| | | | |
|---|---|---|---|
| 1,428,795 | 9/1922 | Mezger | 101/217 |
| 1,804,139 | 5/1931 | Adsit et al. | 101/217 |
| 3,395,638 | 8/1968 | Kirkus et al. | 101/216 |
| 4,589,339 | 5/1986 | Fischer | 101/217 |
| 5,215,013 | 6/1993 | Vrotacoe et al. | 101/217 |
| 5,507,226 | 4/1996 | Burke et al. | 101/375 |

FOREIGN PATENT DOCUMENTS

| | | | |
|---|---|---|---|
| 129759 | 2/1978 | German Dem. Rep. | 101/217 |

*Primary Examiner*—John S. Hilten
*Assistant Examiner*—Leslie J. Grohusky
*Attorney, Agent, or Firm*—Alix, Yale & Ristas, LLP

[57] ABSTRACT

In an offset printing apparatus, the offset blanket is configured to prevent the transfer of ink from the bare metal edges of the lithographic printing plates. These edges may also have burrs which would exacerbate the ink pick-up and transfer of the unwanted ink to the offset blanket and the paper. The offset blanket is shaved down or relieved in the areas juxtaposed to the edges of the printing plates so that the ink will not be transferred.

4 Claims, 3 Drawing Sheets

OFFSET PRINTING HAVING BLANKET CYLINDER WITH BLANKET HAVING DIFFERENT THICKNESSES

BACKGROUND OF THE INVENTION

The present invention relates to offset printing and particularly to the configuration of the rubber cover of the offset cylinder in relation to the printing plates.

In a lithographic offset printing press, the lithographic printing plates are attached to a plate cylinder which rotates in contact with the rubber covered blanket cylinder. The ink from the lithographic printing plates is transferred to the rubber blanket and from there to the paper. The manufacture of lithographic printing plate stock normally involves the processing (graining, anodizing, coating, etc.) of aluminum webs which are the width of several printing plates. After processing, these webs are cut transversely with a shear to the desired plate length and slit lengthwise to the desired plate width to form the individual printing plates. The shearing and slitting can be done in either order as desired. For one example, a typical web is the width of or slightly greater than the width of three Metro size newspaper plates which are in the range of 13⅝ to 13⅞ inches wide. The stock of aluminum web is normally in the range of 41 to 45 inches wide. Two slits are made in the web to form the three plates and the outer edges of the web are also usually slit depending on the exact width of the desired plates in relation to the width of the aluminum web stock and to eliminate imperfect edge coatings.

The process of slitting the web longitudinally is done with rotary slitters. The slitting process of the anodized and treated aluminum substrate exposes the bare metal at the edges of the plates. This bare metal is oleophilic and may be susceptible to ink pick-up from the inking roller and the transfer of that ink to the offset blanket and then to the paper. This can result in an undesirable ink stripe down the edges of the printed page. The slitting process also may create burrs on the slit edges with the burr on one side of a slit extending up on the face of the plate (up-burr) and the burr on the other side of that slit extending down on the back of the plate (down-burr). The height of the burrs varies and is primarily determined by the sharpness of the rotary slitters. The height can usually be kept less than 0.001 inches with a reasonable sharpening schedule. Although the down-burrs on the back of the plates are not a particular problem, the up-burrs present two problems in the offset printing process. The first problem that is created by the burrs on the printing plates is that the up-burrs exacerbate the ink pick-up problem at the plate edges. The second problem is that these up-burrs can damage the offset blankets. To totally eliminate the up-burrs on the front face of the plates would require additional slitting steps to produce all down-burrs. However, this produces scrap plate material which, although a small percentage of the total plate material, would be excessively costly for the mass production of lithographic printing plates. Also, elimination of the up-burrs does not eliminate the ink pick-up problem at the edges caused by the bare metal.

Typical newspaper printing presses have plate cylinders which are either two or four plates wide. The plates are mounted on the cylinders with a space of about ⅛ inch between plates. The offset blanket which picks up the ink from the multiple plates could be made slightly narrower than the outside edges of the plates on the ends of the cylinder such that the blanket will not engage these oleophilic outside edges or the burrs that may be present.

However, the oleophilic edges and the up-burrs that may be on the edges between adjacent plates on the cylinder will still engage the blanket and may transfer ink and damage the blanket.

SUMMARY OF THE INVENTION

An object of the invention is to prevent the transfer of ink from the cut or slit edges of lithographic printing plates to the blanket of the offset cylinder and from the blanket to the paper. Specifically, the invention prevents the transfer of ink from the oleophilic slit edges and from the up-burrs on the plate edges as a result of the slitting operation. Another object is to prevent the up-burrs from damaging the offset blanket. The invention relates to the configuration of the surface of the offset blanket such that the blanket will not cause the transfer of ink from the edges of the plate to the blanket and such that the up-burrs will not damage the blanket. More specifically, the invention involves the slight shaving or relief of the blanket in the regions of the edges of the plates.

DESCRIPTION OF THE PREFERRED EMBODIMENTS

Figure 1:
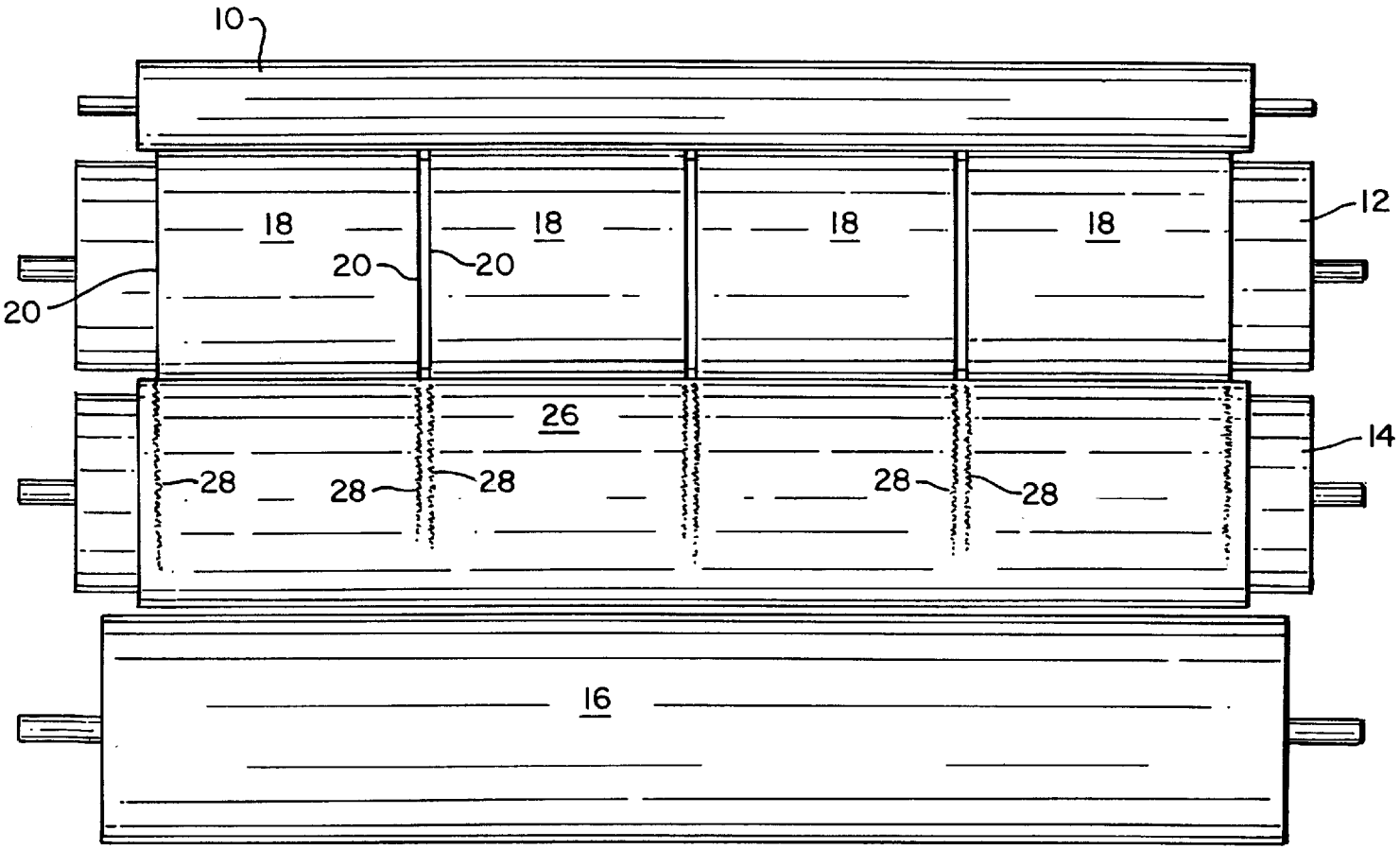
FIG. 1 PRIOR ART
FIG. 1 illustrates the plate cylinder, the offset or blanket cylinder and the impression cylinder along with the inking roller in a conventional offset printing machine.
Figure 2:
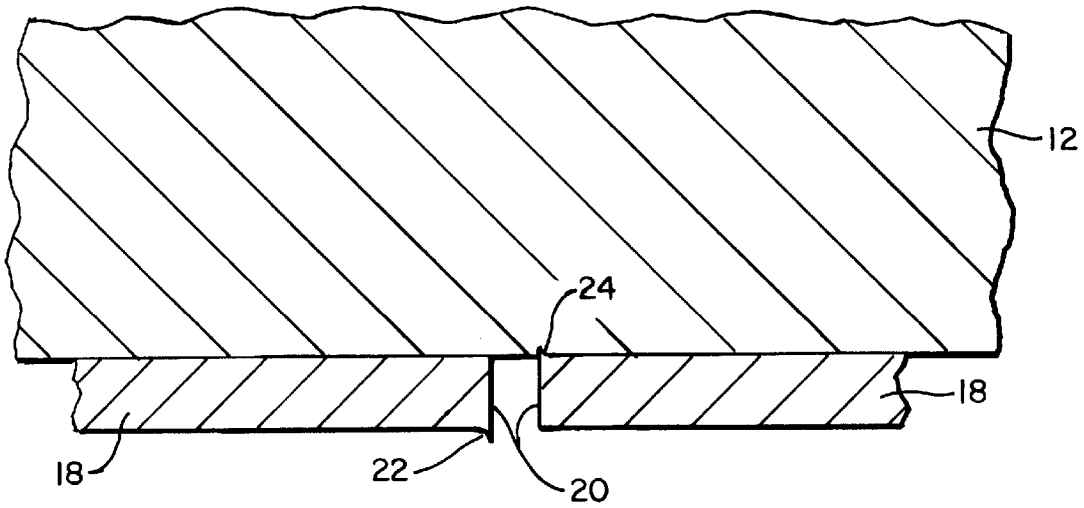
FIG. 2 PRIOR ART
FIG. 2 is an enlarged cross section view of a portion of FIG. 1 showing the burrs on the edges of the printing plates.

FIG. 1 of the drawings illustrates the three primary cylinders of a conventional offset printing press including a plate cylinder 12, a blanket cylinder 14 and an impression cylinder 16 along with an inking roller 10. The plate cylinder 12 is illustrated as having four lithographic printing plates 18 attached thereto, but there could be any number, usually either two or four. This cylinder 12 is mounted in a conventional manner in the printing press such that the images on the printing plates 18 pick up ink from the ink roller 10. The circumferential edges 20 of the printing plates 18 are outside of the image containing area. However, these circumferential edges 20 of the printing plates 18 are usually bare metal as a result of the web slitting operation and these bare metal edges can pick up ink from the inking roller. In addition, these edges will usually have burrs, as shown in FIG. 2 in exaggerated proportions, with the up-burr 22 on the front face of the plate and the down-burr 24 on the back. The up-burrs 22 on the front face of the plates will exacerbate the ink pick-up problem.

In contact with the printing plates 18 is a rubber or other resilient blanket 26 on the blanket cylinder 14. The transfer of ink from the printing plates 18 to the blanket 26 requires some degree of pressure between the printing plate and the blanket with compression of the blanket. Mere contact is usually not sufficient to properly transfer the ink. Although the pressure and amount of compression necessary can vary, the compression is normally in the range of about 10%. As shown in this FIG. 1, the blanket 26 has picked-up ink at 28 from the edges of the printing plate.

Adjacent to the blanket cylinder 14 is the impression cylinder 16. The web of paper to be printed is fed between the blanket 26 and the impression cylinder 16 and the ink image is transferred from the blanket to the paper. The ink 28 from the edges of the plate is also transferred from the blanket to the paper web.

Figure 3:
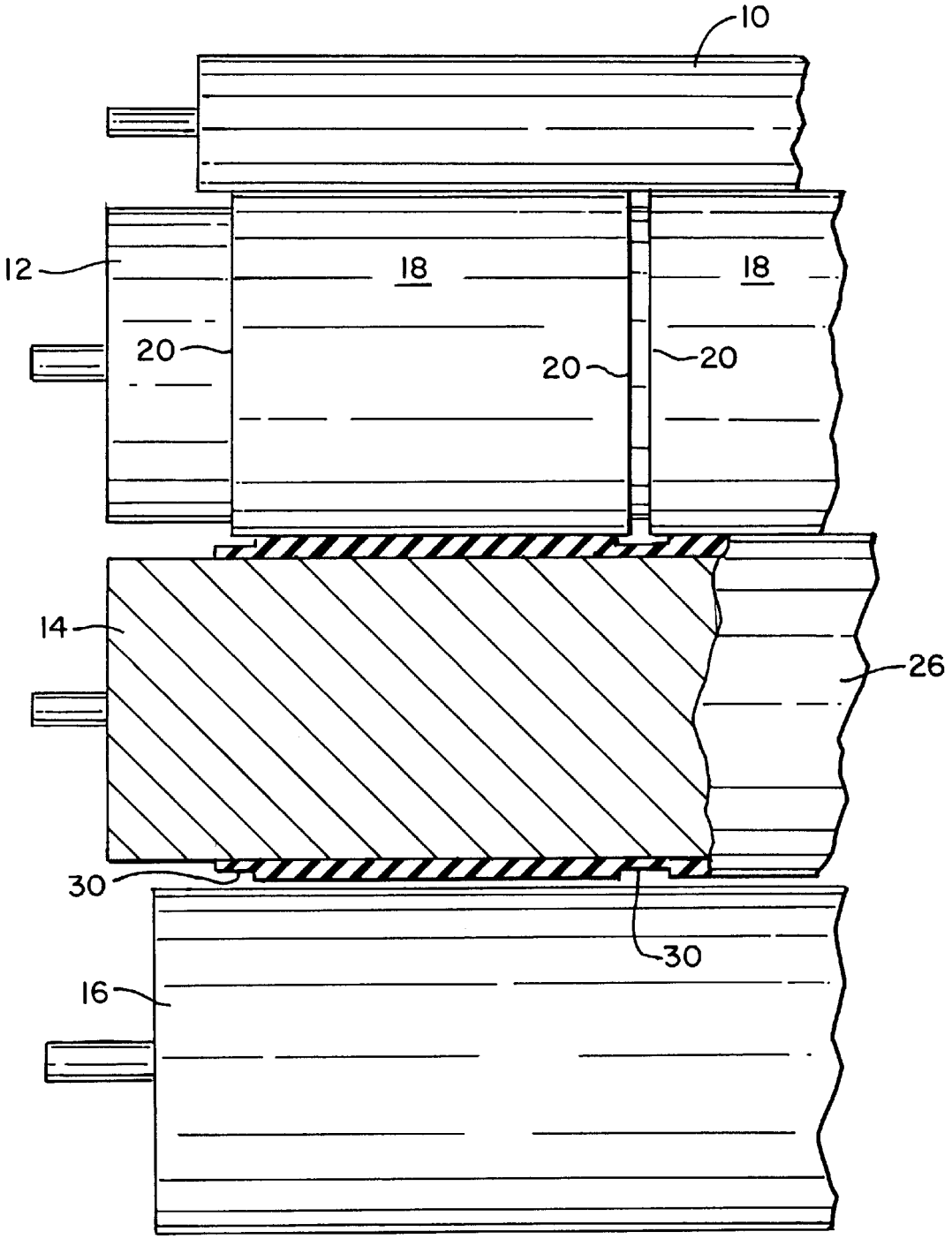
FIG. 3 illustrates a portion of the same cylinders as in FIG. 1 but partially in cross section and with the blanket on the offset cylinder shaped according to the invention.

Turning now to the invention as illustrated in FIG. 3, the blanket 26 of a selected thickness now has relieved or recessed sections 30 of a thickness less than the selected thickness and extending circumferentially around the blanket in the areas adjacent or juxtaposed to the edges 20 of the printing plates 18. This relief 30 is either preformed into the blanket when the blanket is molded or, more likely, formed by shaving down these areas of the preformed blanket. For example, the blanket can be frozen with liquid nitrogen and then ground down the required amount. The width of each relief 30 extends past the edges 20 of the adjacent printing plate 18 an amount preferably only just sufficient to avoid ink pick-up from the plate edge but not extending into the image containing area of the plate.

The depth of the relief 30 is likewise preferably only just sufficient to avoid ink pick-up and blanket damage. Preferably, the depth of the relief 30 is about equal to the amount that the blanket is compressed by the printing plate 18 plus about 0.001 inches to account for the maximum burr height. As just one specific example, for a blanket which is 0.070 inches thick and a compression of 10%, the blanket would be ground down about 0.008 inches. In this way, the relieved areas 28 of the blanket 26 will be spaced from or just barely touch the burrs on the edges 20 of the printing plate 18 but with insufficient pressure to transfer the undesirable ink or damage the blanket.

What is claimed is:

1. In an offset printing press having a plate cylinder, a lithographic printing plate mounted on the plate cylinder wherein the printing plate has image and non-image areas and has side edges extending circumferentially around the plate cylinder which may pick up ink and a blanket cylinder having a resilient blanket in engagement with the image and non-image areas of the printing plate for picking up ink from the image areas of the printing plate and which may pick up ink from the side edges of the printing plate, the improvement wherein the resilient blanket has a selected thickness of engagement with said image and non-image areas of the printing plate and has blanket side edges juxtaposed to the side edges of the printing plate wherein said blanket side edges are of a thickness less than said selected thickness whereby said blanket side edges will not engage and pick up ink from the printing plate side edges.

2. In an offset printing press having a plate cylinder, a plurality of lithographic printing plates mounted on the plate cylinder wherein the printing plates each have image and non-image areas and have non-image containing side edges which side edges may pick up ink and a blanket cylinder having a resilient blanket in engagement with the image and non-image areas of the printing plates, the improvement wherein the resilient blanket has a selected thickness for engagement with said image and non-image areas of the printing plates and has areas extending circumferentially around said blanket juxtaposed to said non-image containing side edges of said printing plates of a thickness less than said selected thickness whereby said blanket will not engage and pick up ink from said non-image containing side edges of said printing plates.

3. In an offset printing press having a plate cylinder, a plurality of anodized aluminum lithographic printing plates mounted on the plate cylinder wherein the printing plates each have image and non-image areas and have bare aluminum non-image containing side edges which bare aluminum side edges may pick up ink and a blanket cylinder having a resilient blanket in engagement with the image and non-image areas of the printing plates, the improvement wherein the resilient blanket has a selected thickness for engagement with said image and non-image areas of the printing plate and has blanket areas extending circumferentially around said blanket juxtaposed to said bare aluminum non-image containing side edges of said printing plates which blanket areas are of a reduced thickness which is less than said selected thickness whereby said blanket will not engage and pick up ink from said bare aluminum non-image containing side edges of said printing plates.

4. In an offset printing press as recited in claim 3 wherein at least some of said bare aluminum side edges have up-burrs and wherein said reduced thickness areas of said blanket are not engaged and damaged by said up-burrs.

* * * * *